US007076075B2

(12) United States Patent
Jørgensen

(10) Patent No.: US 7,076,075 B2
(45) Date of Patent: Jul. 11, 2006

(54) HEARING AID WITH PIVOTABLE BATTERY DRAWER HAVING OPENING IN END WALL FOR BATTERY REMOVAL

(75) Inventor: Michael F. Jørgensen, Hellerup (DK)

(73) Assignee: Oticon A/S, Smørum (DK)

( * ) Notice: Subject to any disclaimer, the term of this patent is extended or adjusted under 35 U.S.C. 154(b) by 330 days.

(21) Appl. No.: 10/450,684

(22) PCT Filed: Dec. 19, 2001

(86) PCT No.: PCT/DK01/00843

§ 371 (c)(1),
(2), (4) Date: Oct. 27, 2003

(87) PCT Pub. No.: WO02/51204

PCT Pub. Date: Jun. 27, 2002

(65) Prior Publication Data

US 2004/0062408 A1 Apr. 1, 2004

(30) Foreign Application Priority Data

Dec. 20, 2000 (DK) ..... 2000 01913

(51) Int. Cl.
*H04R 25/00* (2006.01)

(52) U.S. Cl. ..... 381/323; 381/330; 381/324

(58) Field of Classification Search ..... 381/314, 381/322–324, 328, 330, 381; 429/96–100
See application file for complete search history.

(56) References Cited

U.S. PATENT DOCUMENTS

| | | | | |
|---|---|---|---|---|
| 3,138,491 | A * | 6/1964 | Komatsu et al. | 429/97 |
| 4,153,758 | A * | 5/1979 | Cerny | 429/98 |
| 4,680,799 | A * | 7/1987 | Henneberger | 381/324 |
| 4,941,180 | A | 7/1990 | Buettner | |
| 5,204,917 | A * | 4/1993 | Arndt et al. | 381/324 |
| 6,041,128 | A * | 3/2000 | Narisawa et al. | 381/322 |
| 6,430,296 | B1 * | 8/2002 | Olsen | 381/322 |
| 6,658,125 | B1 * | 12/2003 | Batting | 381/330 |
| 2004/0052390 | A1 * | 3/2004 | Morales et al. | 381/323 |

FOREIGN PATENT DOCUMENTS

WO 0021336 4/2000

* cited by examiner

*Primary Examiner*—Sinh Tran
*Assistant Examiner*—Phylesha Dabney
(74) *Attorney, Agent, or Firm*—Dykema Gossett PLLC

(57) ABSTRACT

A communication device includes a housing in which a battery drawer for accommodating a circular battery is mounted pivotally and in which means for preventing unintended removal of the battery are provided. The battery drawer includes two side elements for preventing gripping of the essentially planar sides of the battery and an aperture intended for insertion of an object for pressing the battery out of the battery drawer.

12 Claims, 6 Drawing Sheets

HEARING AID WITH PIVOTABLE BATTERY DRAWER HAVING OPENING IN END WALL FOR BATTERY REMOVAL

FIELD OF THE INVENTION

The invention relates to a communication device comprising a housing in which a battery drawer is mounted pivotally and in which a means for preventing unintended removal of the battery is provided. Such devices comprise hearing aids, headsets and similar personal communication devices.

BACKGROUND OF THE INVENTION

A communication device of this type is known from CH 688925. In the hearing aid disclosed in this prior art publication the means for preventing unintended opening of the battery drawer comprises a slidably mounted pin element which is slidable into a corresponding blind hole in the housing. This known locking means requires an accurate positioning of the battery drawer in relation to the housing. Furthermore, there is a risk of unintended breaking of the pin element when it positioned in the locking position with the battery drawer open and the battery drawer is afterwards closed. This and other mechanical problems are the result of the relatively small dimensions of such communication device parts. Still furthers, the locking mechanism always has to be actively actuated for the intended functioning. The user often forgets this.

The object of the present invention is to provide a communication device aid of the above-mentioned type which has a reduced risk of breaking the locking means or other mechanical failure and which does not require the separate locking operation by the user in order to function correctly.

SUMMARY OF THE INVENTION

The object of the invention is achieved by means of a communication device which includes a housing having a pivotable battery drawer for a circular battery, the battery drawer including two side elements for preventing gripping of the essentially planar sides of the battery, and an aperture for insertion of an object for pressing the battery out of the battery drawer.

In this manner a child-safe accommodation of a battery in a communication device may be achieved. The construction comprises no mutually movable parts, which contributes significantly to the reliability of the construction. The secure placement of the battery will inherently take place by insertion between the two side elements, wherefore the user will not forget to activate any safety mechanisms, and the removal of the battery is achieved in an easy and controlled manner with a reduced risk of dropping the battery during this process.

The invention will be described more detailed in the following with reference to the drawings.

DESCRIPTION OF THE PREFERRED EMBODIMENT

Figure 1:
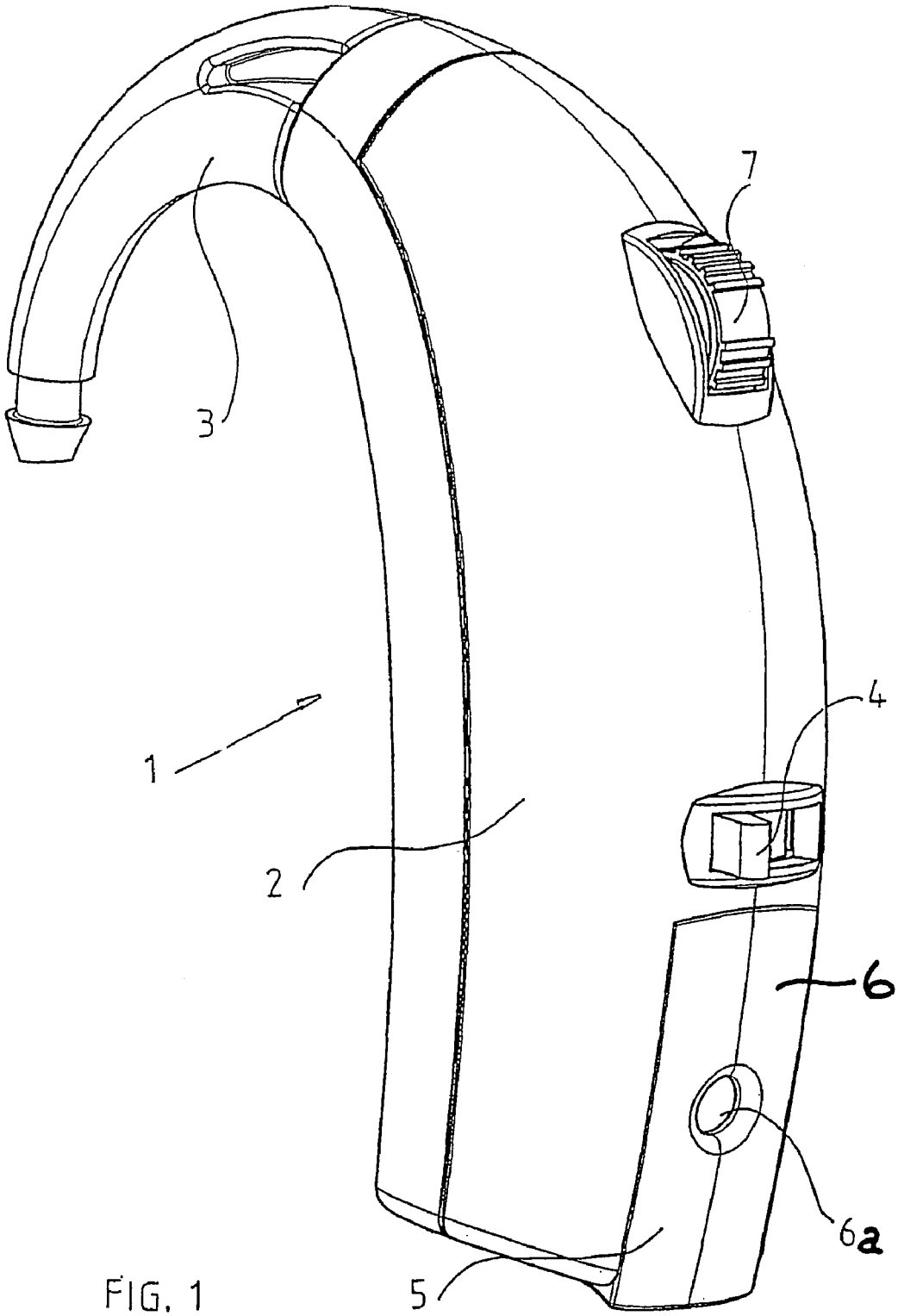
FIG. 1 is a perspective view of a hearing aid according to the invention.

From FIG. 1 a communication device in the form of a hearing aid 1 appears, which comprises a housing 2. At one end the housing carries a so-called hook 3 and at the opposite end a battery drawer 5 is provided. An aperture 6*a* is provided in end wall 6 of the battery drawer. Furthermore, a switch 4 and a volume control 7 are provided, however, these elements have no effect as such on the present invention.

Figure 2:
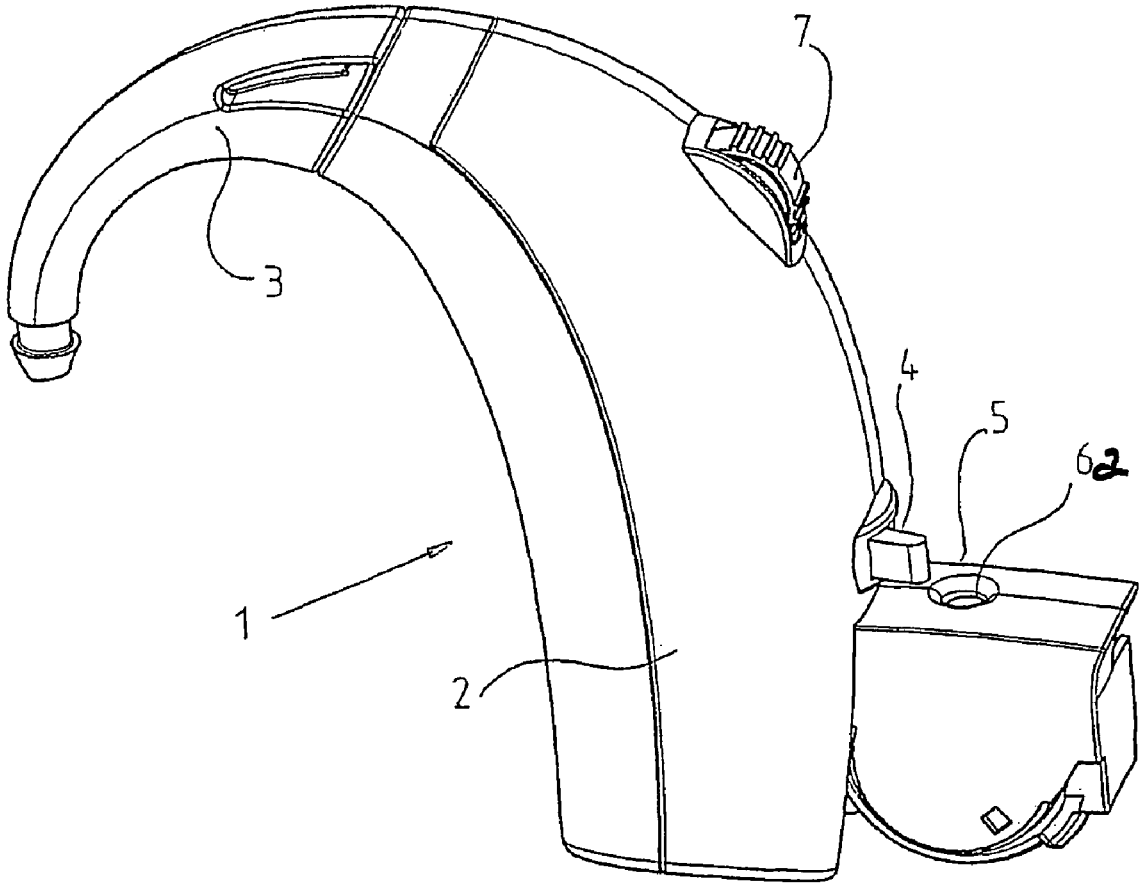
FIG. 2 is a rear view of the hearing aid of FIG. 1, with the battery drawer in an open position.

From FIG. 2 the same hearing aid 1 appears is a situation where the battery drawer 5 has been pivoted in relation to the housing 2. The aperture 6*a* in the end wall 6 is still accessible in this position of the battery drawer.

Figure 3:
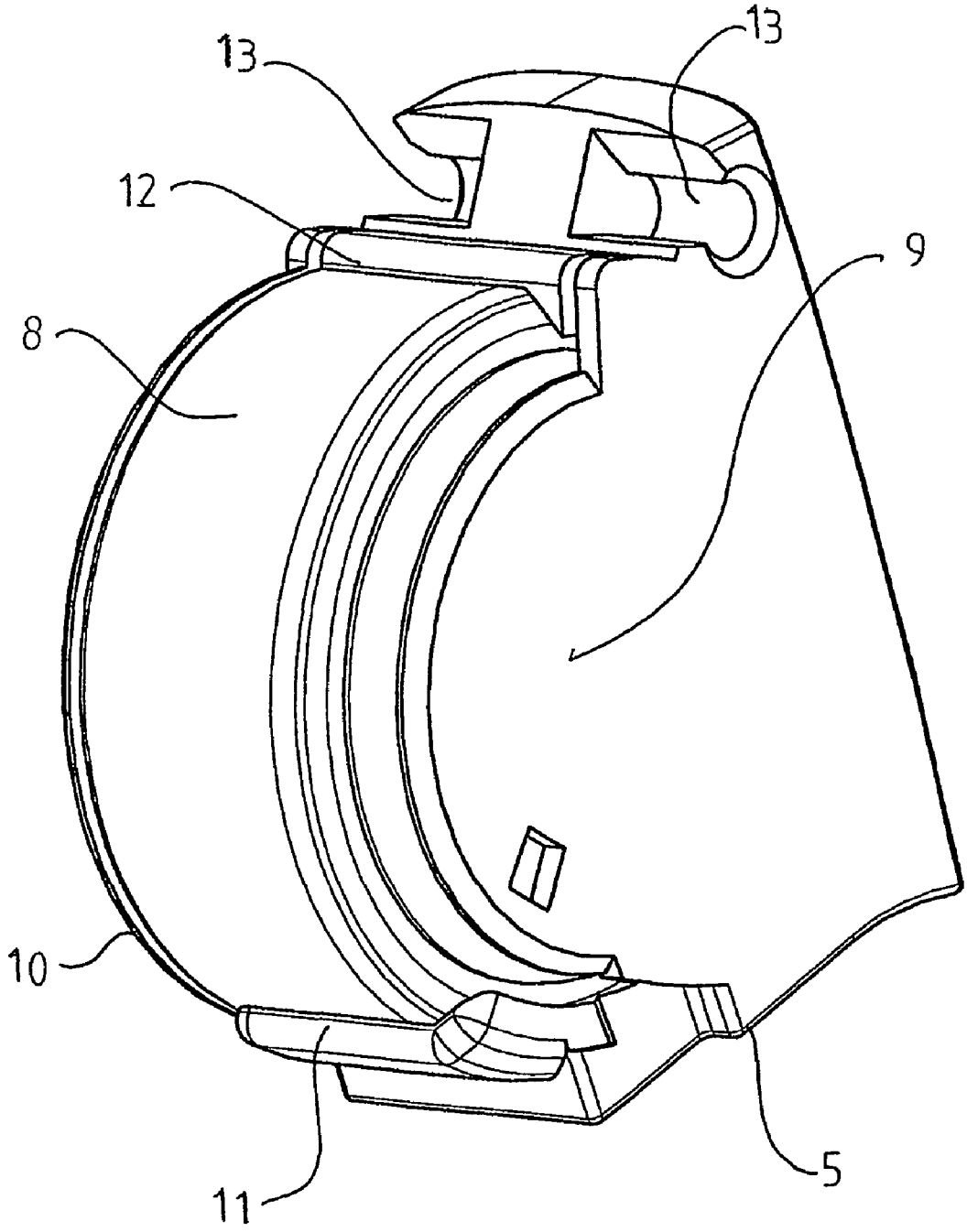
FIG. 3 is a perspective view of a battery drawer with a battery.

From FIG. 3 a battery drawer is shown in a state where it has been separated from the hearing aid housing. A circular battery 8, a so-called button cell, appears in a position where it is inserted in the battery drawer 5 and where the circular circumference of the battery is held by mutually opposed holding means 11,12, where at least one of these, in this case the holding means 11, may be flexed to allow insertion as well as removal of the battery 8. The distance between the outer ends of the holding means 11, 12 is smaller than the diameter of the battery in order to maintain the battery in the battery drawer. The sides of the battery are covered by side parts 9,10 of the battery drawer, which side parts prevent gripping of the battery sides for removal of the battery. Recesses 13 for accommodating shaft parts in the hearing aid housing are provided.

Figure 4:
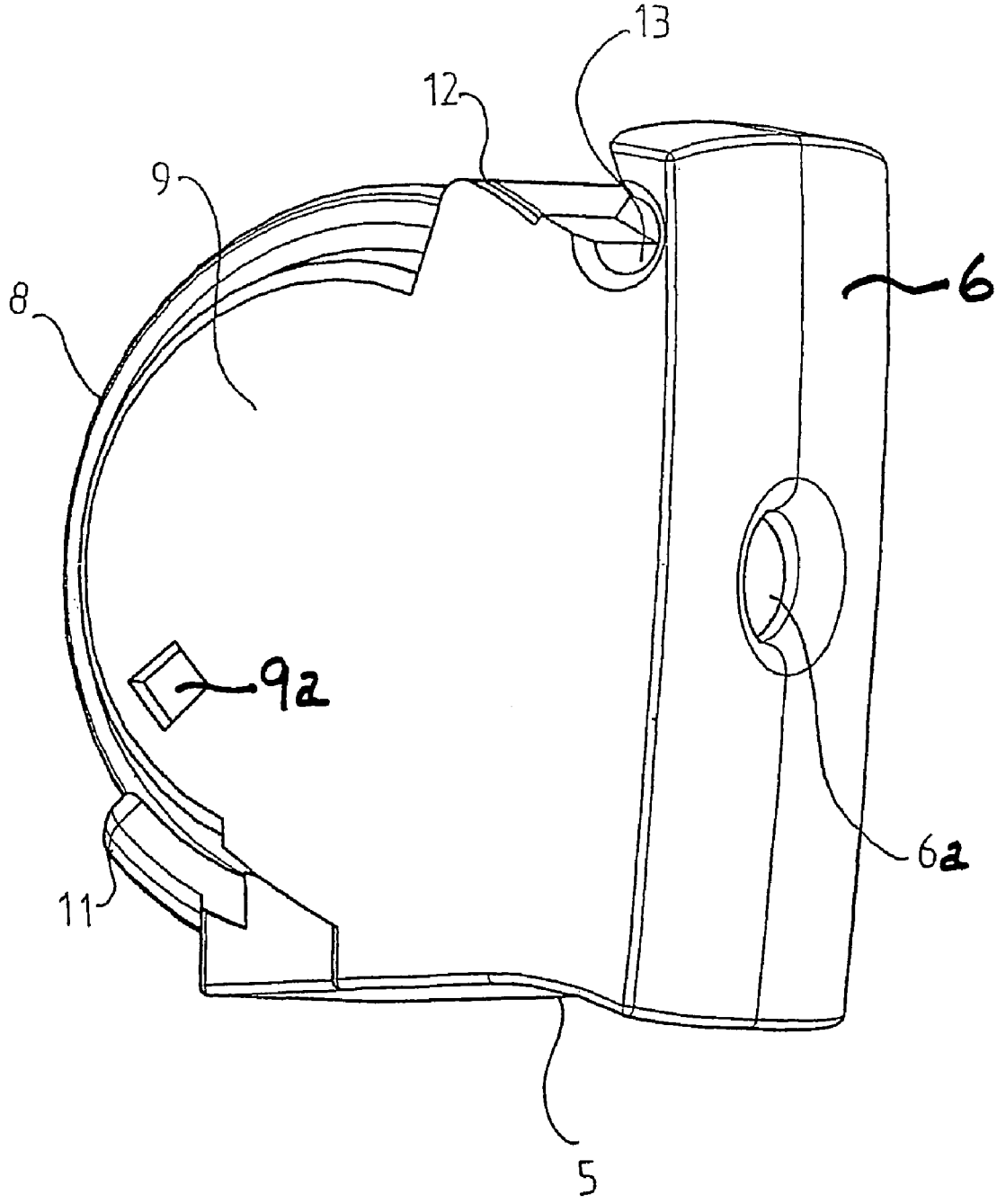
FIG. 4 is a perspective view of a battery drawer with a battery.

From FIG. 4 the battery drawer 5 appears in another view where the aperture 6*a* is visible. For removal of the battery, an object having a size smaller than the aperture 6*a* is inserted through the aperture 6*a* and the battery is radially forced out of the battery drawer by overcoming the holding force of the holding means 11,12.

Figure 5:
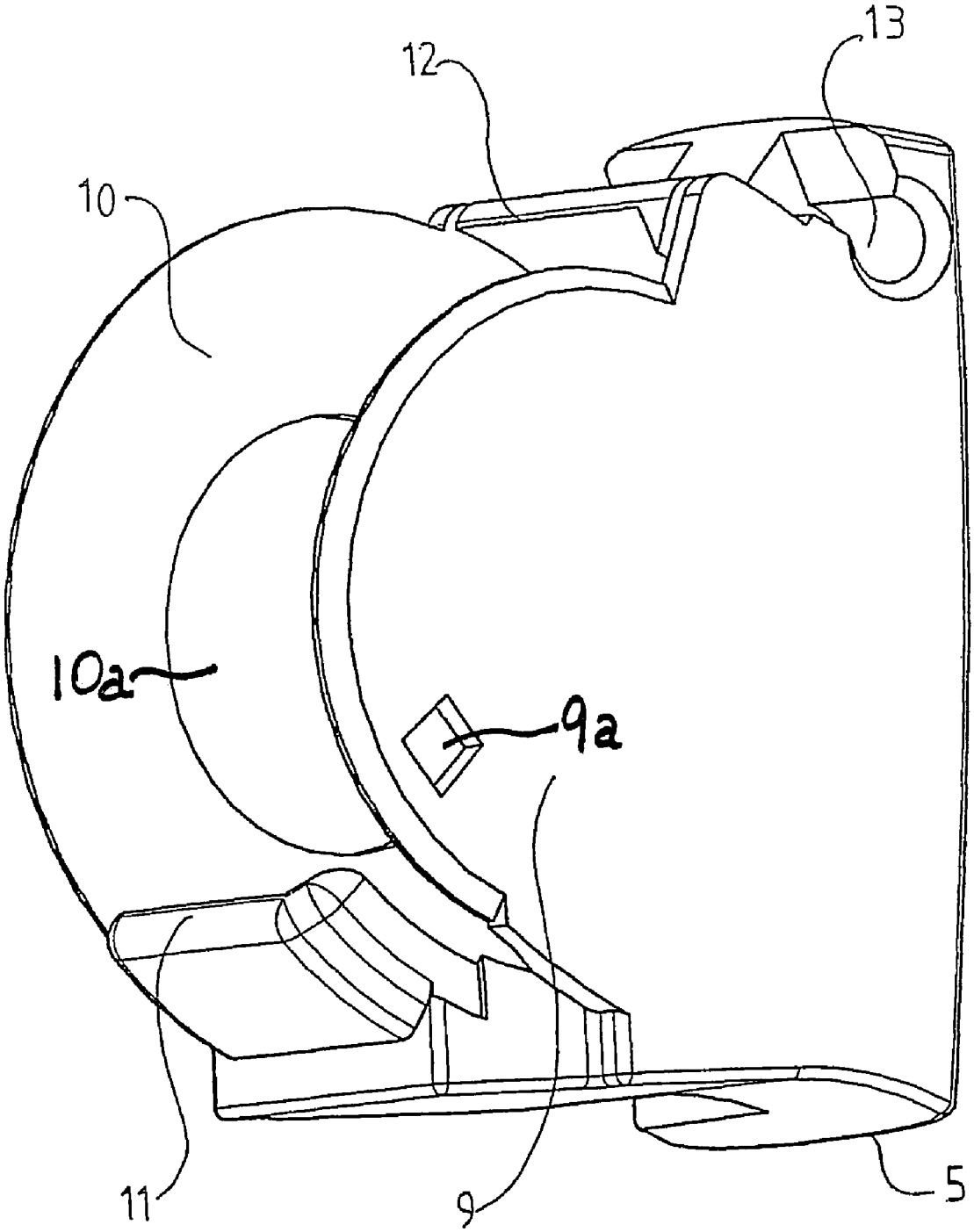
FIG. 5 is a perspective view of a battery drawer without battery.
Figure 6:
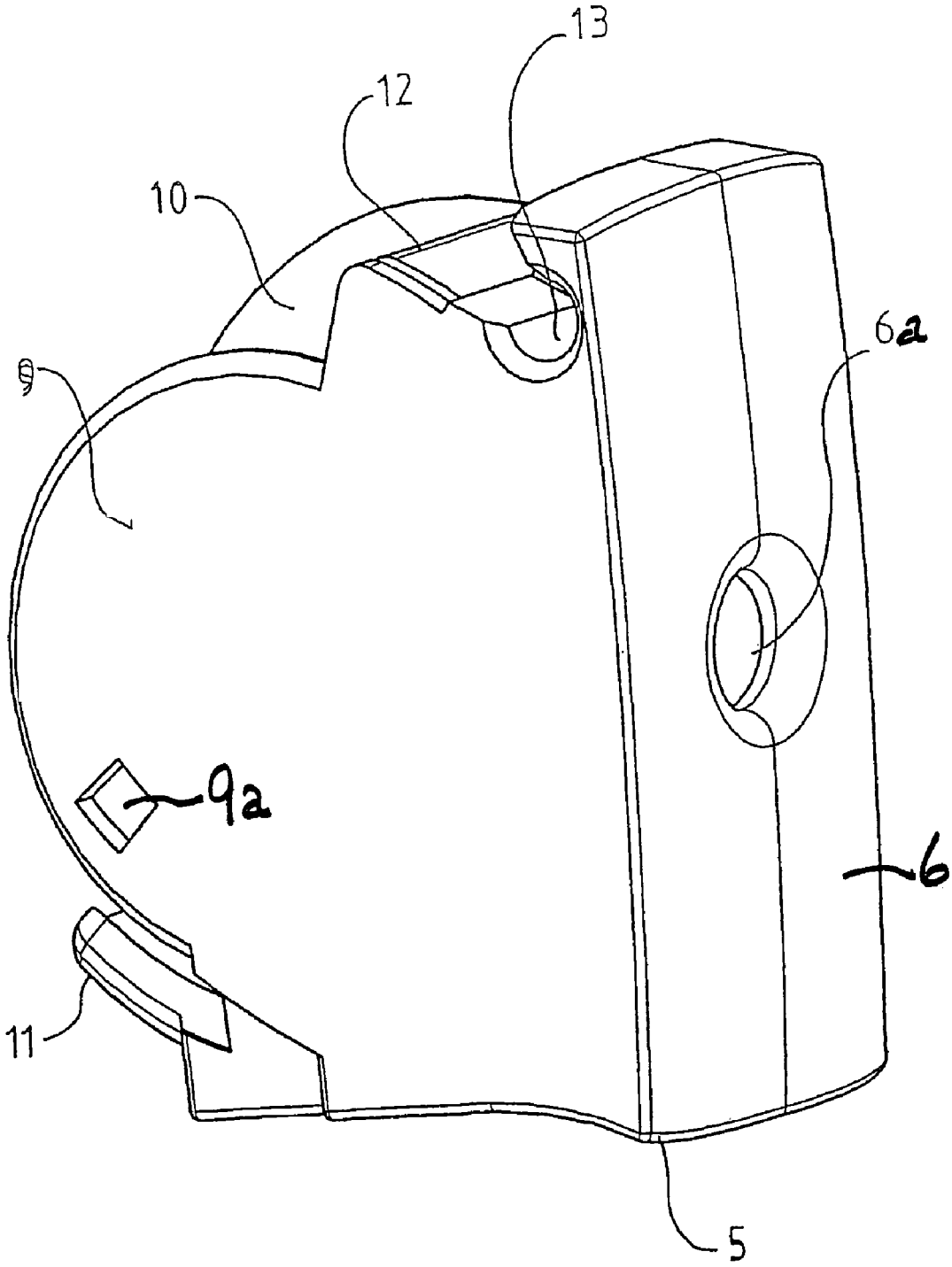
FIG. 6 is a perspective view of a battery drawer without battery.

From FIG. 5 and FIG. 6 the battery drawer is shown without the battery. The side elements 9,10 appear clearer as well as the flexible holding means 11. The holding means could comprise two flexible arms without influencing the functionality of the invention. The side element 9 includes an opening 9*a* for electrical contact with a pole of a circular battery between side elements 9,10, and the side element 10 includes an incision 10*a* for establishing electrical contact with a battery pole.

The battery drawer could be mounted with a fixed shaft that would make the connection between the housing and the battery drawer more rigid and secure.

The invention claimed is:

1. A communication device comprising a housing and a battery drawer for accommodating a circular battery pivotally mounted to the housing, said battery drawer comprising first and second side elements for containing the circular battery therebetween, said first and second side elements preventing gripping of the essentially planar sides of the battery, and an end wall which extends between said first and second side walls and which includes an aperture for insertion of an object to radially push the battery out from between the first and second side walls.

2. A communication device according to claim 1, wherein holding elements are provided in the battery drawer for holding the battery on a circular circumference thereof.

3. A communication device according to claim 2, wherein two said holding elements are provided with a mutual distance smaller than a diameter of the battery.

4. A communication device according to claim 1, wherein at least one of the first and second side elements includes an opening for establishing electrical contact with a battery pole.

5. A communication device according to claim 1, wherein at least one of the side elements includes an incision for establishing electrical contact with a battery pole.

6. A communication device according to claim 1, where the entire area of the surface circumscribed by the circular battery is covered by the side elements.

7. A battery drawer for use in a communication device comprising a housing in which a battery drawer for accommodating a circular battery is mounted pivotally and in which means for preventing unintended removal of the battery are provided, wherein the battery drawer comprises first and second side elements for containing the circular battery therebetween and for preventing gripping of the essentially planar sides of the battery, and an end wall which extends between said first and second side walls and which includes an aperture for insertion of an object for pushing the battery out of from between the first and second side walls.

8. A battery drawer according to claim 7, wherein a plurality of holding elements are provided in the battery drawer for holding a battery on a circular circumference thereof.

9. A battery drawer according to claim 8, wherein two holding elements are provided with a mutual distance smaller than a diameter of the battery.

10. A battery drawer according to claim 7, wherein at least one of the side elements includes an opening for establishing electrical contact with a battery pole.

11. A battery drawer according to claim 7, wherein at least one of the side elements includes an incision for establishing electrical contact with a battery pole.

12. A battery drawer according to claim 7, wherein the first and second side elements completely cover opposite sides of the circular battery.

* * * * *